US006866246B2

(12) United States Patent
Collier

(10) Patent No.: US 6,866,246 B2
(45) Date of Patent: Mar. 15, 2005

(54) BALANCE SHAFT JACK CRADLE

(75) Inventor: Dennis Collier, Westland, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 10/438,408

(22) Filed: May 15, 2003

(65) Prior Publication Data

US 2004/0227134 A1 Nov. 18, 2004

(51) Int. Cl.[7] ..... B66F 3/00
(52) U.S. Cl. ..... 254/2 B
(58) Field of Search ..... 254/2 B, 133 R, 254/8 B, 93 H, 89 H, 134

(56) References Cited

U.S. PATENT DOCUMENTS

| | | | | | |
|---|---|---|---|---|---|
| 3,958,793 | A | * | 5/1976 | Garate | 254/10 B |
| 4,540,147 | A | * | 9/1985 | Lincourt | 248/352 |
| 4,899,985 | A | | 2/1990 | Good | 254/8 B |
| 5,190,265 | A | | 3/1993 | Barry et al. | 254/8 B |
| 5,203,540 | A | | 4/1993 | Lee | 254/8 B |
| 5,251,875 | A | | 10/1993 | Craychee et al. | 254/8 B |
| 5,372,353 | A | * | 12/1994 | West | 254/10 B |
| 5,800,094 | A | * | 9/1998 | Jones | 405/230 |
| 6,000,681 | A | | 12/1999 | Hussaini | 254/101 |
| 6,089,545 | A | | 7/2000 | Norman et al. | 254/134 |
| 6,416,039 | B1 | | 7/2002 | Pietrusynski | 254/8 B |
| 6,427,979 | B1 | | 8/2002 | Vogt | 254/133 |

* cited by examiner

*Primary Examiner*—Lee D. Wilson
(74) *Attorney, Agent, or Firm*—Daniel J. Donahue; Bliss McGlynn, P.C.

(57) ABSTRACT

A cradle assembly adapted to support a balance shaft assembly. The cradle assembly includes an attachment plate adapted to be supported by the lifting mechanism of a typical jack, a base plate, and a plurality of legs disposed between the base plate and the attachment plate such that the base plate is operatively supported above the attachment plate at a predetermined distance. The cradle assembly further includes a plurality of cradle blocks having a top engagement surface and a base surface, the base surface of each of the plurality of cradle blocks is supported upon the base plate and the top engagement surfaces of the cradle blocks is formed so as to support predetermined portions of the balance shaft assembly. The cradle blocks thereby engage and support the balance shaft assembly as the cradle assembly is brought into contact with the balance shaft assembly by the operation of the attached jack.

18 Claims, 3 Drawing Sheets

BALANCE SHAFT JACK CRADLE

BACKGROUND OF THE INVENTION

1. Field of the Invention

The invention relates, generally, to a supporting cradle adapted for use with a lifting device and, more specifically, to a supporting cradle adapted to be used with a jack to lift and support the balance shaft assembly of a diesel engine.

2. Description of the Related Art

In certain types of diesel engines that are used for industrial purposes and for those used in motor vehicles, it is known to employ a counter shaft, or counter shaft assembly. These counter shaft assemblies, also referred to as balance shafts and balance shaft assemblies, are used to, provide counter balance, and thus smooth operation, to the crankshaft of the engine. Counter balance is required with certain engine configurations, such as four cylinder engines for example, where the combustion forces from the power stroke of each cylinder occur at high angular differences from each other.

In the case of the four-cylinder engine, the typical crankshaft configuration places the two end pistons and the two middle pistons in the same relative position within their relative cylinder bores at any given time. Thus, when the number 1 piston is at the top of its stroke at top dead center (TDC), then the number 4 piston is also at TDC. Concurrently, the number 2 and number 3 pistons will both be at bottom dead center (BDC). In four-stroke diesel engines, this lends itself well to the timing of the combustion for each cylinder, which produces the power stroke and imparts the motive force to the crankshaft. Specifically, as the number 1 piston reaches TDC in its compression stroke and the fuel/air mixture is ignited to begin the power stroke by driving the piston downward, the number 4 is piston is reaching TDC of its the exhaust stroke and will begin its intake stroke during power stroke of piston number 1. Subsequently, as the number 1 piston is driven downward in its power stroke, one of the rising pistons (typically piston number 3) is in its compression stroke and will start its power stroke as it reaches TDC and piston numbers 1 and 4 reach BDC.

In a four-stroke, four-cycle diesel engine, combustion and a new power stroke begins every 180 degrees of crankshaft rotation. Arranging the pistons in relation to each other in this manner allows the power stroke of each piston to be fully complete before starting the next combustion stroke. However, each power stroke generates additional vertical forces that are not passed to the crankshaft but are passed to the engine itself. Since the piston that is being driven downward in its power stroke by the combustion forces is moving faster than the piston rising in the compression stroke, the vertical forces in the engine block are not cancelled out. Additionally, the 180 degree differential in power strokes alternately creates angular force on the forward half of the crankshaft the first ½ rotation, then an angular force acting on the rear half of the crankshaft in the second ½ rotation. This fore and aft, combustion-generated, angular force each 180 degrees of crankshaft rotation causes end-to-end engine vibration. The vertical force vibration and the end-to-end vibration result in rough engine operation in the four-cylinder engine. This is especially true of large displacement four cylinder diesel engines when they are operated at low speeds. In contrast, six-cylinder engines have much more rotational inertia and can function well with the pistons angularly offset typically at 120 degree intervals, which allow the power strokes to occur 3 times for each revolution of the crankshaft providing inherently smooth operation, and negating the need for counter-balancing.

In order to overcome the inherent vibration and rough running problem in a four-cylinder, four-stroke diesel engine, it is known in the related art to employ a balance shaft assembly. One approach that has met with limited success involves the use of a single counterweighted balance shaft that is directly installed in the engine block. The balance shaft is operatively connected to and rotates with the crankshaft. However, a more successful approach to countering four-cylinder engine vibration has been to employ a separate multiple counter-balance shaft assembly that is operatively driven by the crankshaft. These separate balance shaft assemblies often include heavy castings that operatively retains two heavily weighted counter balance shafts driven in counter rotation by the crankshaft. The balance shaft assembly is physically located at the bottom of the engine block just above the oil pan and often incorporates the oil pump assembly into the same gearing that drives the balance shafts.

The weight of the balance shaft assembly successfully adds stabilizing inertia to the engine to counter the end-to-end vibration, as well as providing the rotational counter-balance to cancel the vertical vibration forces. This produces a smooth running four-cylinder diesel engine. However, whenever these engines must undergo maintenance, the heavy balance shaft assembly causes difficulties in its handling for removal and replacement. For example, in the case of a four-cylinder, four-cycle diesel engine, the balance shaft assembly is bolted to the bottom of the engine block and includes the oil pump and oil pump pickup tube which extends down into the oil pan. Any servicing of the oil pump or components located in the bottom end of the engine, such as main bearings or connecting rod bearings requires removal of the balance shaft assembly. If it is necessary to remove the engine from the vehicle, the balance shaft assembly is also generally removed first to reduce the engine weight and simplify engine removal.

Removal of the balance shaft assembly is problematic due to its weight and location as installed in a vehicle. Known methods of removal generally require the physical efforts of two or more individuals to handle the assembly and one other individual to loosen and remove the bolts holding it to the engine. Sometimes a jack may also be employed to assist in raising or lowering the balance assembly to or from the engine block. However, if the vehicle is sitting on its wheels or only raised up on jack stands for limited underneath access, the balance shaft assembly is physically close to the ground and it is difficult to get the necessary individuals or a jack under the vehicle to handle the assembly while it is being unbolted and removed or being reinstalled and bolted in. Additionally, a typical floor jack is inadequate to support the balance shaft assembly and can cause the assembly to drop to the floor.

Likewise, if the vehicle is raised up on a lift or hoist, the access to the balance shaft assembly is better but the weighty assembly is difficult to hold overhead and then lower to the ground as its is unbolted, or to lift and hold in it place when reinstalling it. Additionally, the oil pump pick up tube extends downward from the balance shaft assembly and it is easily damaged if the assembly is not carefully removed. If a jack is employed to assisting in holding the balance shaft assembly when the vehicle is on a lift or hoist, it is generally a transmission type jack due to its ability to reach the level of the engine. However, a transmission jack is not adequate to properly support the assembly. In this case, extreme care must be taken to avoid damaging the oil pickup tube or having the balance shaft assembly slide off of the jack and drop to the floor. At present, there are no known jack types or cradle assemblies that can be employed to properly assist in the removal and replacement of balance shaft assemblies.

Therefore, there exists a need in the art for a supporting fixture that can be used with existing jacking mechanisms to properly cradle and support a balance shaft assembly so that it can be easily raised and lowered to and from the engine block. There is also a need for such a fixture so that a single individual can raise and lower a balance shaft assembly to install or remove it.

SUMMARY OF THE INVENTION AND ADVANTAGES

The present invention overcomes the disadvantages of the related art by providing a cradle assembly that is adapted to support a balance shaft assembly while it is removed from or remounted to an engine. The cradle assembly includes an attachment plate adapted to be supported by the lifting mechanism of a typical jack, a base plate, and a plurality of legs disposed between the base plate and said attachment plate such that the base plate is operatively supported above the attachment plate at a predetermined distance. The cradle assembly further includes a plurality of cradle blocks, each having a top engagement surface and a base surface, the base surface of each of the plurality of cradle blocks is fixedly supported upon the base plate and the top engagement surfaces of the cradle blocks are formed so as to support predetermined portions of the balance shaft assembly. The plurality of cradle blocks thereby engage and support the balance shaft assembly as the cradle assembly is brought into contact with the balance shaft assembly by the operation of the attached jack. This allows the balance shaft assembly to be supported in place solely by the present invention while a single individual unbolts it from the engine.

The present invention also overcomes the disadvantages of the related art by providing a manner in which the balance shaft assembly can be lowered from the engine and wheeled about by a single individual due to the present invention's adaptation to a typical jack or lifting mechanism. Likewise, the same disadvantages are overcome by the present invention's ability to allow a single individual to lift and support a balance shaft assembly up to the bottom of the engine when installing the balance shaft assembly to an engine. Accordingly, the cradle assembly of the present invention eliminates the need to have multiple individuals support and manipulate the balance shaft assembly of a four-cylinder engine when it is necessary to remove or replace the assembly from the engine.

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE PREFERRED EMBODIMENT(S)

Figure 1:
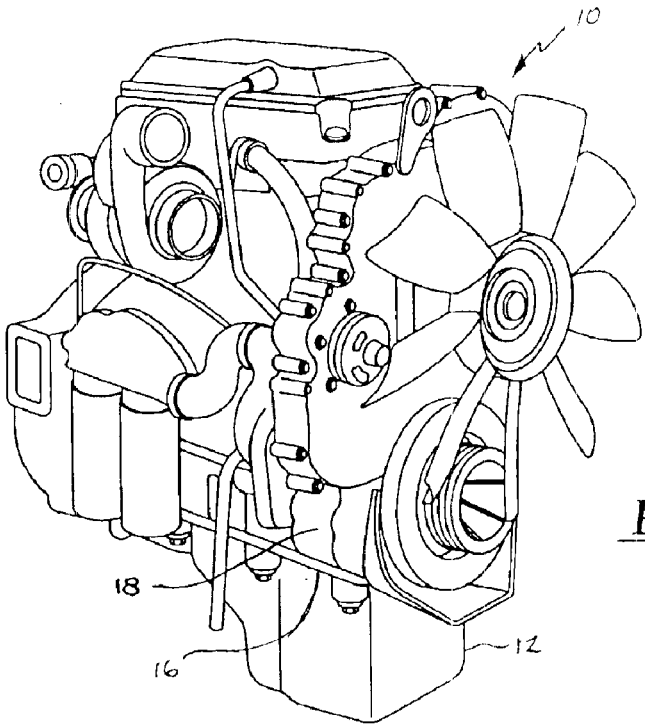
FIG. 1 is an perspective view of a typical four-cylinder, four-stroke diesel engine having a balance shaft assembly.
Figure 2A:
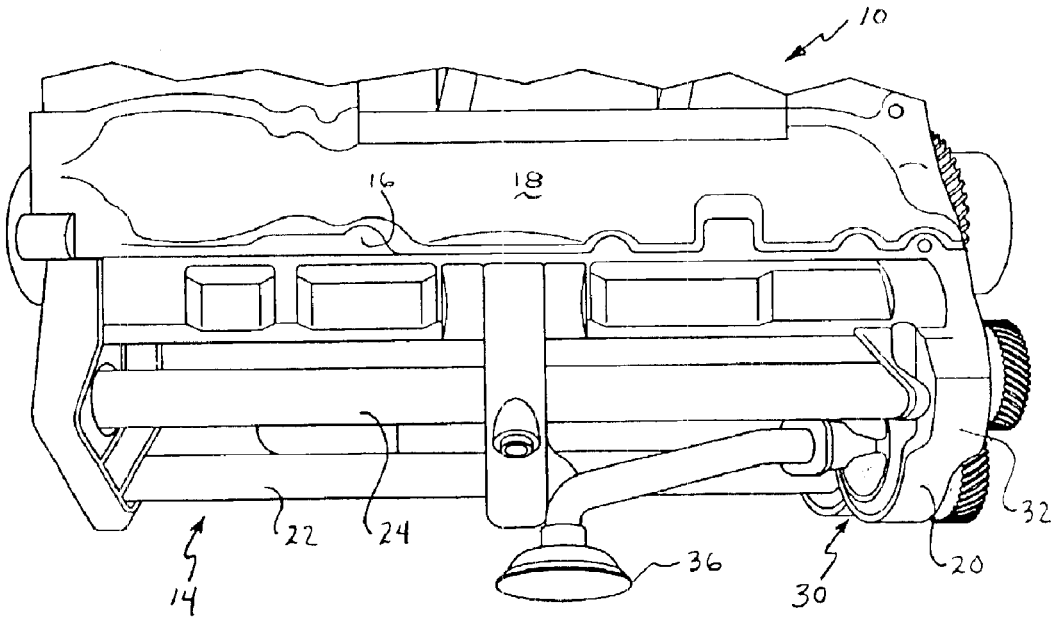
FIG. 2A is a side view of a diesel engine having a balance shaft assembly with the oil pan removed to expose the balance shaft assembly.
Figure 2B:
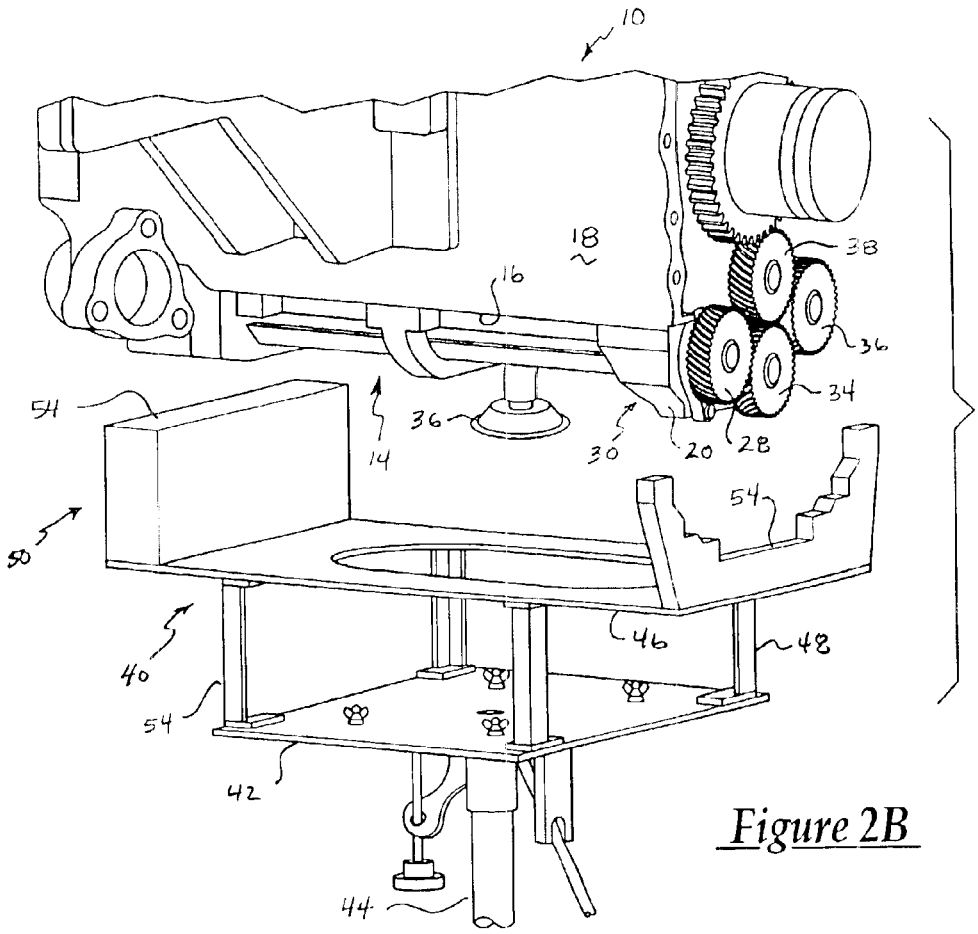
FIG. 2B is a perspective view of a diesel engine having a balance shaft assembly with the oil pan removed to expose the balance shaft assembly.

A four-cylinder, four-cycle diesel engine of the type that typically employs a balance shaft assembly to operatively counteract inherent vibration and roughness is generally indicated at 10 in FIG. 1, where like numerals are used to designate like structure throughout the drawings. FIG. 2A shows the engine 10 with its oil pan 12 removed in anticipation of maintenance on the bottom half of the engine or in preparation for engine removal. The balance shaft assembly, generally indicated at 14, is bolted in place on the bottom surface 16 of the engine block 18. As best seen in FIG. 2B, the balance shaft assembly 14 includes a casting 20 that is horizontally bored to receive the right and left balance shafts 22, 24. The balance shaft assembly 14 also includes the right and left balance shaft drive gears 26, 28, and a gear-type oil pump, generally indicated at 30. The gears of the gear-type oil pump 30 are disposed within the front portion 32 of the casting 20 behind the balance shaft drive gears 22 and 24 and are not shown in the Figures.

The oil pump 30 is operatively driven by the oil pump drive gear 34. An oil pump pickup tube 36 that feeds the oil pump 30 extends from the casting 20 into the sump of the oil pan 12. An intermediate gear 38 is driven from the crankshaft to spin the oil pump drive gear 34, which subsequently drives the two balance shaft drive gears 26 and 28. Due to the interaction of the drive gears 26 and 28 with the oil pump drive gear 34, the balance shafts 22 and 24 rotate in opposite directions (i.e., counter-rotate) to counteract the vibration generated within the engine.

Figure 3:
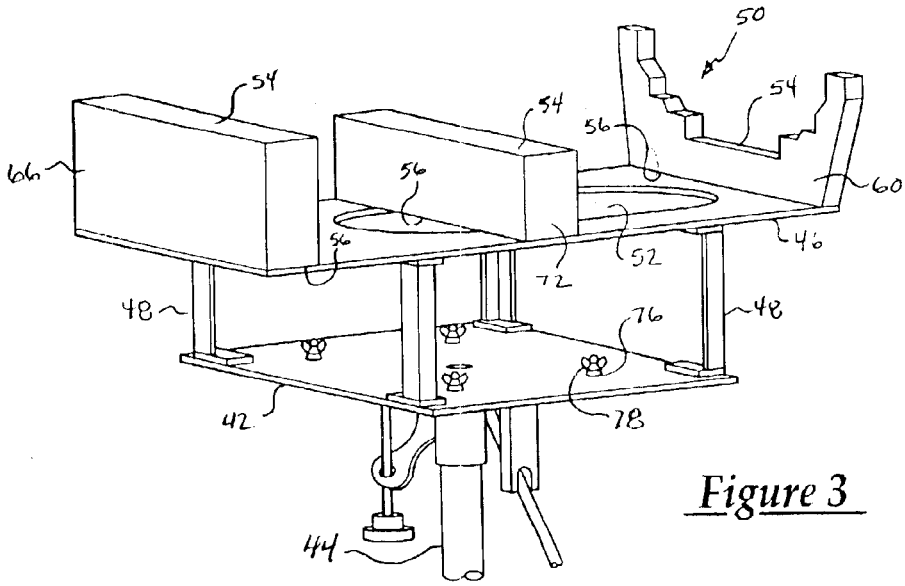
FIG. 3 is a perspective view of the balance shaft jack cradle of the present invention illustrating in detail the features of the invention.
Figure 4:
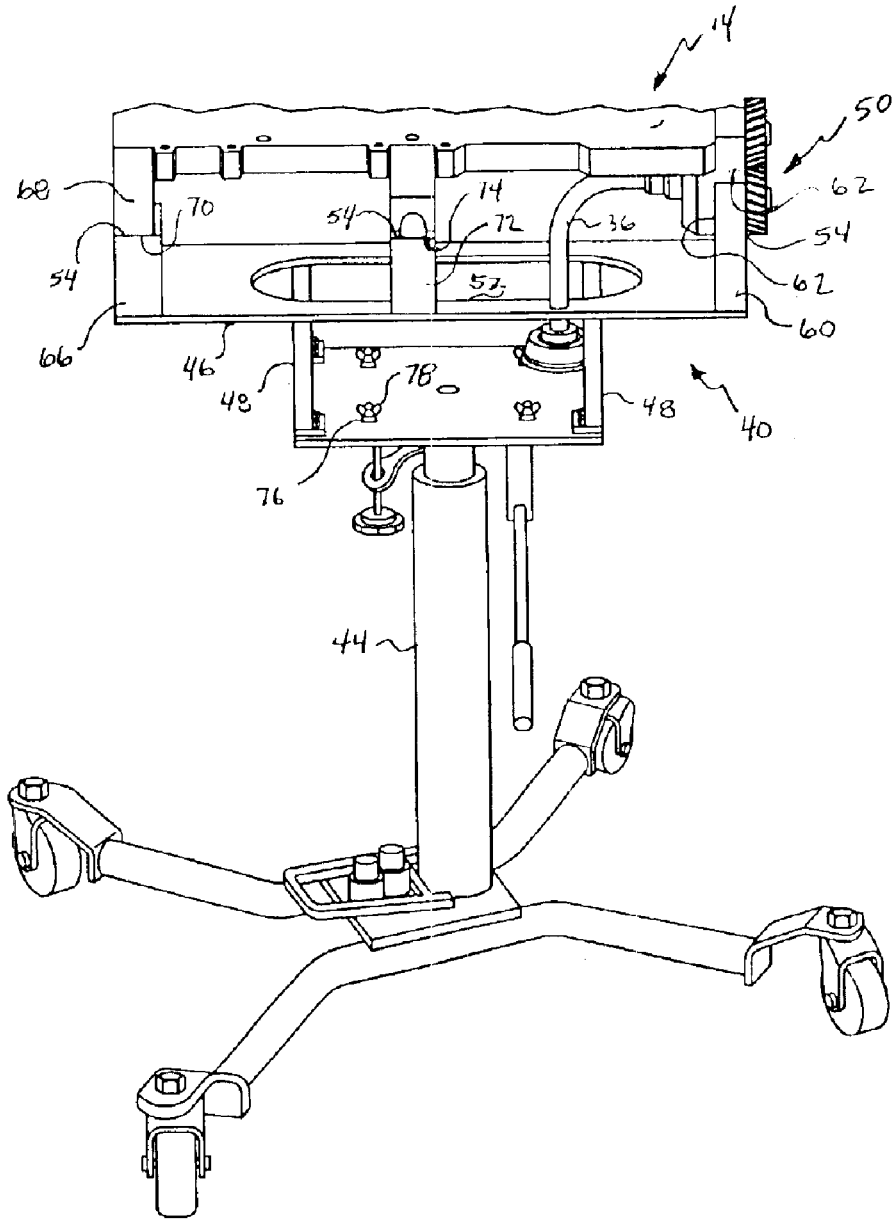
FIG. 4 is a side view of the balance shaft jack cradle of the present invention as mounted on a typical transmission jack supporting a balance shaft assembly.

Current methods of removal and replacement of the balance shaft assembly 14 typically require a number of individuals to physically support and maneuver the assembly while another individual bolts or unbolts it from the engine 10. To overcome the drawbacks and disadvantages of the current methods of removing and replacing a balance shaft assembly of this and similar types, a cradle assembly of the present invention, generally indicated at 40 in FIGS. 3 and 4, is provided. The cradle assembly 40 is adapted to support the balance shaft assembly 14 so that it can be unbolted and removed from the engine 10 by a single individual. Additionally, when supported by the cradle assembly 40, the balance shaft assembly 14 can be lowered and easily wheeled about by a singular individual.

As shown in FIG. 3, the cradle assembly 40 includes an attachment plate 42 that is adapted to be supported by the lifting mechanism of a typical jack 44 and abase plate 46. A plurality of legs 48 are disposed between the base plate 46 and the attachment plate 42. In addition, the cradle assembly 40 includes a plurality of cradle blocks, generally indicated at 50. The base plate 46 further includes a central opening 52 that is designed to accommodate the oil pickup tube 36 that extends downward from the balance shaft assembly 14. The plurality of legs 48 are formed having a predetermined length such that the base plate 46 is operatively supported above the attachment plate 42 at a predetermined distance. The predetermined distance created by the length of the plurality of legs 48 is sufficient to allow the oil pickup tube 36 to extend through the central opening 52 of the base plate 46 and not come in contact with the attachment plate 42 when the cradle assembly 40 engages the balance shaft assembly 14 (see FIG. 4).

FIG. 4 shows the balance shaft assembly 14 removed from the engine 10 and supported on the present invention. Each of the plurality of cradle blocks 50 have a top engagement surface 54 and a base surface 56. The base surface 56 of each of the plurality of cradle blocks 50 is fixedly supported upon the base plate 46. The top engagement surfaces 52 of the cradle blocks are formed so as to support predetermined portions of the balance shaft assembly 14. The plurality of cradle blocks 50 thereby engage and support the balance shaft assembly 14 as the cradle assembly 40 is brought into contact with the balance shaft assembly 14 by the operation of the attached jack. The plurality of cradle blocks 50 includes a forwardmost cradle block 60 that is adapted to be supported on one end of the base plate 46 such that the forwardmost cradle block 60 will be brought into engagement with the forward portion 62 of the balance shaft assembly 14. It should be appreciated that the top engagement surface 54 of the forwardmost cradle block 60 is contoured so that it presents surfaces that are complementary to the bottom surface 64 of the forward portion 62 of the balance shaft assembly 14. In this way, the forwardmost cradle block 60 is adapted to engage and support the forward portion 62 of the balance shaft assembly 14 on the cradle assembly 40.

Likewise, the plurality of cradle blocks 50 further include a rearmost cradle block 66 that is adapted to be supported on the end of said base plate 46 opposite the forwardmost cradle block 60 such that the rearmost cradle block 66 will be brought into engagement with the rear portion 68 of the balance shaft assembly 14. Furthermore, the top engagement surface 54 of the rearmost cradle block 66 is contoured so that it presents surfaces that are complementary to the bottom surface 68 of the rear portion 70 of the balance shaft assembly 14. In this way, the rearmost cradle block 66 is adapted to engage and support the rear portion 70 of the balance shaft assembly 14 on the cradle assembly 40.

The plurality of cradle blocks 50 may also include at least one cradle block that is disposed intermediate or between the forwardmost and rearmost cradle blocks 60, 66. More specifically, the intermediate cradle block 72 is supported along a portion of the base plate 46 between the forwardmost and the rearmost cradle blocks 60 and 66 such that the intermediate cradle block 72 will be brought into engagement with the balance shaft assembly 14 between the front and rear portions 62 and 70. It should be appreciated that the top engagement surface 54 of the intermediate cradle block 72 may be contoured so that it presents surfaces that are complementary to the bottom surface 74 of the balance shaft assembly 14 between the front and rear portions 62 and 70. In this way, the intermediate cradle block 72 is adapted to engage and support the balance shaft assembly 14 on the cradle assembly 40 between the front and rear portions 62 and 70. It should be appreciated that the present invention may be used without the intermediate cradle block 72, or with additional intermediate blocks without departing from the scope of the invention.

It should be further appreciated that the attachment plate 42 includes a plurality of holes 76 that operatively coincide with a like plurality of holes in the lifting plate of the typical transmission jack 44. In this manner, the plurality of holes 76 in the attachment plate 42 thereby providing operative openings for the insertion of fasteners 78 to physically connect the attachment plate 42 to the lifting plate of a jack. It should be further appreciated that the jack may be a typical hydraulic transmission jack as generally depicted in the Figures. Alternatively, the plurality of holes 76 may be configured so as to provide attachment to any other type of available jack.

In operation, to remove the balance assembly 14 from the engine 10, the oil pan 12 must first be removed and the attachment plate 42 of the cradle assembly 40 of the present invention must be mounted, in any known fashion, to an appropriate jack 44. The jack 44, with the attached cradle assembly 40, is positioned under the engine 10. The cradle assembly 40 is oriented such that the forwardmost cradle block 60 is in alignment with the forward portion 62 of the balance assembly 14 and the rearmost cradle block 66 is in alignment with the rear portion 68. The jack 44 is then actuated so that the cradle assembly 40 is elevated until it comes in contact with and supports the balance assembly 14. In this position, the forwardmost cradle block 60 supports the forward portion 62 of the balance assembly 14 and the rearmost cradle block 66 supports the rear portion 68.

While the balance assembly 14 is supported in this manner, it is unbolted and thereby freed from the engine block 18. This causes the balance assembly to rest in the cradle assembly 40. The jack 44 is then lowered so that the cradle assembly 40 and the balance shaft assembly 14 will clear the undercarriage of the vehicle. The jack 44, cradle assembly 40, and balance shaft assembly 14 are then wheeled out from under the vehicle. The balance shaft assembly 14 may remain in the cradle assembly 40 until reinstallation onto the engine 10 or it may be lifted off the cradle assembly 40 as necessary. Reinstallation of the balance shaft assembly 14 is accomplished in a reverse manner, such that the jack 44, cradle assembly 40, and balance shaft assembly 14 are elevated to align the balance shaft assembly 14 with the engine block 18. With the balance shaft assembly 14 supported in place by the jack 44 and the cradle assembly 40, the balance shaft assembly 14 is bolted to the engine block 18. All of these activities may be easily carried out by one individual.

Accordingly, the cradle assembly of the present invention provides the ability for a single individual to operatively support lower, and maneuver the balance shaft assembly of a four-cylinder diesel engine when it is necessary to remove it from the engine and in a like manner, individually raise and support it for installation onto an engine. Thus, the cradle assembly of the present invention eliminates the need to have multiple individuals support and manipulate the balance shaft assembly of a four-cylinder engine when it is necessary to remove or replace the assembly from the engine.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

I claim:

1. A cradle assembly adapted to support a balance shaft assembly for an engine, said cradle assembly includes:

an attachment plate adapted to be supported by the lifting mechanism of a typical jack;

a base plate having a central opening to accommodate the oil pickup tube that extends downward from said balance shaft assembly;

a plurality of legs disposed between said base plate and said attachment plate such that said base plate is operatively supported above said attachment plate at a predetermined distance; and a plurality of cradle blocks having a top engagement surface and a base surface, said base surface of each of said plurality of cradle blocks fixedly supported upon said base plate and said top engagement surfaces of said cradle blocks formed so as to support predetermined portions of the balance shaft assembly, said plurality of cradle blocks thereby engaging and supporting the balance shaft assembly as said cradle assembly is brought into contact with the balance shaft assembly by the operation of the attached jack.

2. A cradle assembly as set forth in claim 1 wherein said plurality of legs that operatively support said base plate above said attachment plate at said predetermined distance have a length sufficient to allow the oil pickup tube to extend through said central opening in said base plate and not come in contact with said attachment plate when said cradle assembly engages the balance shaft assembly.

3. A cradle assembly as set forth in claim 1 wherein one of said plurality of cradle blocks is further defined as being the forwardmost cradle block, said forwardmost cradle block adapted to be supported on one end of said base plate such that said forwardmost cradle block will be brought into engagement with the forward portion of the balance shaft assembly.

4. A cradle assembly as set forth in claim 3 wherein said top engagement surface of said forwardmost cradle block is further defined as having a contoured surface that is complementary to the bottom surface of the forward portion of the balance shaft assembly such that said forwardmost cradle block is adapted to engage and support the forward portion of the balance shaft assembly on said cradle assembly.

5. A cradle assembly as set forth in claim 4 wherein one of said plurality of cradle blocks is further defined as being the rearmost cradle block, said rearmost cradle block adapted to be supported on the end of said base plate opposite said forwardmost cradle block such that said rearmost cradle block will be brought into engagement with the rear portion of the balance shaft assembly.

6. A cradle assembly as set forth in claim 5 wherein said top engagement surface of said rearmost cradle block is further defined as having a contoured surface that is complementary to the bottom surface of the rear portion of the balance shaft assembly such that said rearmost cradle block is adapted to engage and support the rear portion of the balance shaft assembly on said cradle assembly.

7. A cradle assembly as set forth in claim 6 wherein at least one of said plurality of cradle blocks is further defined as being an intermediate cradle block, said intermediate cradle block adapted to be supported along a portion of said base plate between said forwardmost and said rearmost cradle blocks such that said intermediate cradle block will be brought into engagement with the balance shaft assembly between the front and rear portions.

8. A cradle assembly as set forth in claim 7 wherein said top engagement surface of said intermediate cradle block is further defined as having a contoured surface that is complementary to the bottom surface of the balance shaft assembly between the front and rear portions such that said intermediate cradle block is adapted to engage and support the balance shaft assembly on said cradle assembly between the front and rear portions.

9. A cradle assembly as set forth in claim 1 wherein said attachment plate further includes a plurality of holes that operatively coincide with a like plurality of holes in the lifting plate of the typical transmission jack, said plurality of holes in said attachment plate thereby providing operative openings for the insertion of fasteners to physically connect said attachment plate to the lifting plate of the transmission jack.

10. A jack assembly adapted to support a balance shaft assembly for an engine, said jack assembly comprising:

a jack having a lifting mechanism and an attachment plate adapted to be supported by said lifting mechanism of said jack; and a cradle including a base plate having a central opening to accommodate the oil pickup tube that extends downward from the balance shaft assembly, a plurality of legs disposed between said base plate and said attachment plate such that said base plate is operatively supported above said attachment plate at a predetermined distance, and a plurality of cradle blocks having a top engagement surface and a base surface, said base surface of each of said plurality of cradle blocks fixedly supported upon said base plate and said top engagement surfaces of said cradle blocks formed so as to support predetermined portions of the balance shaft assembly, said plurality of cradle blocks thereby engaging and supporting the balance shaft assembly as said cradle is brought into contact with the balance shaft assembly by the operation of the attached jack.

11. A jack assembly as set forth in claim 10 wherein said plurality of legs that operatively support said base plate above said attachment plate at said predetermined distance have a length sufficient to allow the oil pickup tube to extend through said central opening in said base plate and not come in contact with said attachment plate when said cradle engages the balance shaft assembly.

12. A jack assembly as set forth in claim 10 wherein one of said plurality of cradle blocks is further defined as being the forwardmost cradle block, said forwardmost cradle block adapted to be supported on one end of said base plate such that said forwardmost cradle block will be brought into engagement with the forward portion of the balance shaft assembly.

13. A jack assembly as set forth in claim 12 wherein said top engagement surface of said forwardmost cradle block is further defined as having a contoured surface that is complementary to the bottom surface of the forward portion of the balance shaft assembly such that said forwardmost cradle block is adapted to engage and support the forward portion of the balance shaft assembly on said cradle.

14. A jack assembly as set forth in claim 13 wherein one of said plurality of cradle blocks is further defined as being the rearmost cradle block, said rearmost cradle block adapted to be supported on the end of said base plate opposite said forwardmost cradle block such that said rearmost cradle block will be brought into engagement with the rear portion of the balance shaft assembly.

15. A jack assembly as set forth in claim 14 wherein said top engagement surface of said rearmost cradle block is further defined as having a contoured surface that is complementary to the bottom surface of the rear portion of the balance shaft assembly such that said rearmost cradle block is adapted to engage and support the rear portion of the balance shaft assembly on said cradle.

16. A jack assembly as set forth in claim 15 wherein at least one of said plurality of cradle blocks is further defined as being an intermediate cradle block, said intermediate cradle block adapted to be supported along a portion of said base plate between said forwardmost and said rearmost cradle blocks such that said intermediate cradle block will be brought into engagement with the balance shaft assembly between the front and rear portions.

17. A jack assembly as set forth in claim 16 wherein said top engagement surface of said intermediate cradle block is further defined as having a contoured surface that is complementary to the bottom surface of the balance shaft assembly between the front and rear portions such that said intermediate cradle block is adapted to engage and support the balance shaft assembly on said cradle between the front and rear portions.

18. A jack assembly as set forth in claim 10 wherein said attachment plate further includes a plurality of holes that operatively coincide with a like plurality of holes in said lifting plate of said jack, said plurality of holes in said attachment plate thereby providing operative openings for the insertion of fasteners to physically connect said attachment plate to said lifting plate of said transmission jack.

* * * * *